United States Patent [19]

Colli et al.

[11] Patent Number: 4,917,562

[45] Date of Patent: Apr. 17, 1990

[54] BARRIER-WALL DEVICE FOR SUBDIVIDING AMOUNTS OF PIRNS ACCUMULATED IN BULK

[75] Inventors: Luigi Colli; Roberto Badiali; Claudio Pasut, all of Pordenone, Italy

[73] Assignee: Savio, S.p.A., Pordenone, Italy

[21] Appl. No.: 133,639

[22] Filed: Dec. 16, 1987

[30] Foreign Application Priority Data

Dec. 23, 1986 [IT] Italy ..... 22811 A/86

[51] Int. Cl.[4] ..... B65H 67/06

[52] U.S. Cl. ..... 414/420; 198/444; 414/422; 414/425; 57/281; 242/35.5 A

[58] Field of Search ..... 414/404, 414, 418, 421, 414/425, 419; 198/463.6, 444, 425, 530, 540, 524, 502.2; 222/197; 57/90, 281; 242/35.5 A, 35.5 R; 221/254

[56] References Cited

U.S. PATENT DOCUMENTS

| | | | |
|---|---|---|---|
| 3,016,166 | 1/1962 | Furst | 242/35.5 A |
| 3,064,357 | 11/1962 | Butlers | 198/502.2 X |
| 3,207,287 | 9/1965 | Ponsen | 198/463.6 |
| 3,447,707 | 6/1969 | Furst | 242/35.5 R |
| 4,580,698 | 4/1986 | Ladt et al. | 198/505 X |

FOREIGN PATENT DOCUMENTS

| | | | |
|---|---|---|---|
| 1478768 | 3/1969 | Fed. Rep. of Germany | 198/444 |
| 2630438 | 4/1978 | Fed. Rep. of Germany | 198/463.6 |
| 3327426 | 2/1985 | Fed. Rep. of Germany | 198/444 |
| 367420 | 3/1963 | Switzerland | 242/35.5 A |
| 855074 | 11/1960 | United Kingdom | 242/35.5 A |

*Primary Examiner*—Robert J. Spar
*Assistant Examiner*—Robert S. Katz
*Attorney, Agent, or Firm*—Hedman, Gibson, Costigan & Hoare

[57] ABSTRACT

A device is disclosed, which is useful for subdividing and diluting an accumulated amount of pirns in bulk, which comprises a chute positioned between a pirn container, and a conveyor belt. The conveyor belt is prearranged to transfer and meter a limited number of pirns. Along the chute, at least one barrier wall is provided, which can move along a vertical, or substantially vertical, direction, and is driven by a drive source, whose enabling is commanded by a level sensor located downstream the same barrier wall. A plurality of movable barrier walls, following each other, transversely prearranged along the chute relatively to the pirn falling motion, can be used. Each barrier wall is driven by a drive source, whose enabling is commanded by a level sensor located downstream of the barrier wall.

4 Claims, 2 Drawing Sheets

BARRIER-WALL DEVICE FOR SUBDIVIDING AMOUNTS OF PIRNS ACCUMULATED IN BULK

The present invention relates to a device suitable for subdividing and diluting an amount of pirns accumulated in bulk, in order to prearrange said pirns on a limited number of metering and transferring means. These can be a belt means, or a conveyor means provided with continuous or intermittent motion, capable of delivering to the downstream-located means a limited number of pirns.

Herein, exclusive reference to the spinning pirns will be made, it being understood that the device of the invention can also be used for an accumulated amount of tubes, or axially symmetrical bodies supplied to the chute.

In the textile field, to automatically feed the operating fronts of winding machines, e.g., automatic coner machines, there are two main problems: taking the pirns from a container wherein they are stored in bulk, and positioning them at high speed on the travelling distributor means, to meet the requirements of the many winding stations closely positioned to each other.

Storing the pirns in bulk inside container boxes simplifies the storage operations at the spinning manufacturing bays, but makes it necessary to perform the operations of dilution and singling at the winding bays. Said operations must be reliable and fast within an integral factory automation.

During the winding process the winding operating front continuously requires new pirns from the travelling distributor. This distributor receives pirns prearranged and prepared for the unwinding. As a consequence, the container boxes containing the pirns from the spinning bays are continuously sent to the lifting device by lifting and tilting said container boxes and making the pirns come together on a chute. During the tilting action the pirns fall down as an accumulated amount from the container box on the chute. They then all slide down the chute by gravity all without any limiting controls on the metering belt. As a consequence of the above, damages occur in the yarn wound on the pirns due to the excessive friction by superimposition. This causes the yarn turns to shift in such ways that the free ends of the yarn on the pirns get entangled with one another. Such tangles cause considerable difficulties when the individual pirns are separated from one another.

Finally, another drawback occurs, wherein different amounts of exiting pirns appear at each progressing actuation of the metering belt, according to the accumulated amount present on said belt. A further drawback is that tangling of the yarns with one another, in a large accumulated amount of pirns, causes a union block. This prevents the pirns laying on said metering belt from leaving it. This causes the downstream conveyor systems not to be fed with pirns. Obstacles like these mentioned above, even if reduced in number result in considerable delays in the subsequent steps of the production cycle because of the high production speed of present textile machines.

The purpose of the present invention is to overcome the drawbacks of the prior art.

In accordance therewith, the present invention relates to an improved device for subdividing and diluting an accumulated bulk amount of pirns. The pirns fall down onto a chute by tilting from a container box. The chute is provided with at least one movable barrier wall which can move along a vertical, or substantially vertical direction and is driven by a drive source. This drive source is enabled by a level sensor located downstream of the barrier wall.

Said movable barrier wall performs the function of limiting the entrance and the falling down of the pirns, a desired amount of which is laid on the metering belt.

This metering belt can be a continuous flat belt, a slate-belt, or it can be provided with variously shaped protrusions.

In order to improve the performance of the device of the present invention, a plurality of movable barrier walls following each other can be prearranged to partition and dilute the accumulated amount of pirns with a higher precision by mutual coordination and cooperation of sequential movements. Finally, by means of such an improvement the pirns stored in bulk deposit themselves on the metering and conveyor belt in lined-up positions, thus avoiding the risk of pirns in a considerably oblique position.

In accordance with a preferred form of practical embodiment, the device of the present invention is equipped with a plurality of prearranged movable barrier walls following each other along the chute and capable of moving along a vertical, or substantially vertical direction. Each of said movable barrier walls are associated with a lever sensor provided downstream said movable barrier wall. Each movable barrier wall is actuated, in coordinated cooperation with the other movable barrier walls, by a drive source which is enabled by its own level sensor.

The present invention is now explained by referring to the hereto attached drawing tables, wherein.

In the Figures equal elements or elements performing the same or equivalent functions are indicated by the same reference numerals.

Figure 1:
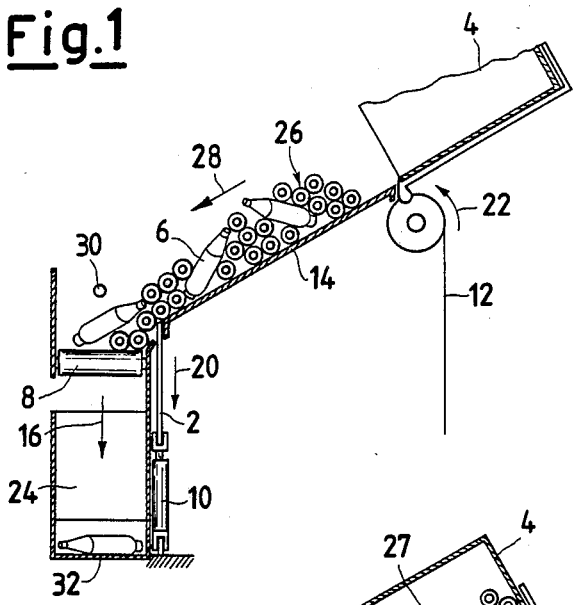
FIG. 1 is a side diagram showing pirns falling or sliding due to gravity along the metering and conveyor belt, with the movable barrier wall being in its lowest sunk, no-interference position. The pirns are being deposited on said metering belt.
Figure 2:
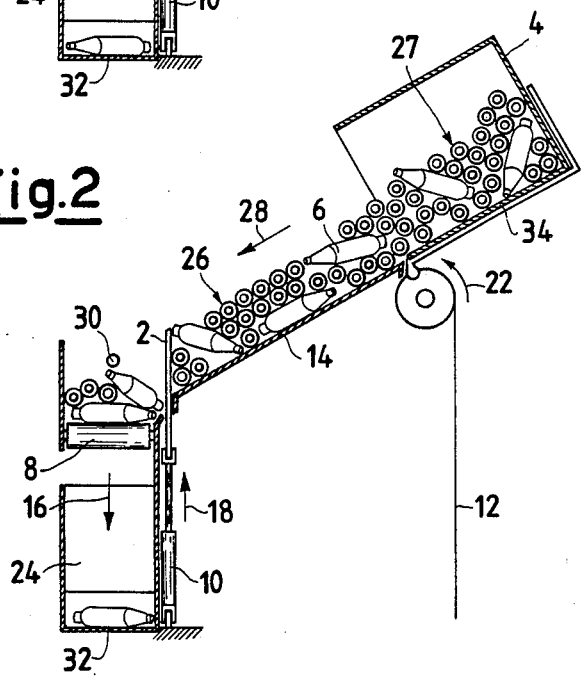
FIG. 2 is a side diagram showing an already tilted container box for pirns in bulk, wherein said pirns due to gravity, prearrange themselves and accumulate on the chute and press against the barrier of the movable barrier wall which is in its highest-lifted position.

In them:

is the movable barrier wall provided with the possibility of vertically moving under the direct action of a pneumatic actuator, or of other similar actuators known from the art;

is a movable barrier wall also provided with the possibility of vertically moving under the direct action of a pneumatic actuator, or of other similar actuators known from the art;

is the container box for pirns stored in bulk at the spinning bays;

is a movable barrier wall provided with the possibility of vertically moving in coordinated sequence of movement with the other movable barrier walls with which the device is equipped;

is the spinning pirn stored inside the container boxes 4 at the spinning bays;

is the metering and conveyor belt on which the pirns are deposited and delivered in a limited number to the downstream conveyor means. The pirns appear thereon in mutually lined-up positions following each other to the taking unit of the free-yarn-end-seeking device. Said belt can be given the structure of a continuous flat belt, a slate-belt, or it can be provided with variously shaped protrusions.

is a pneumatic actuator or a similar device, which controls the vertical shifting of the movable barrier wall 2;

is a pneumatic actuator or a similar device, which controls the vertical shifting of the movable barrier wall 3;

is the track of the chain or of a similar kinematic element, which operates within the device controlling the lifting and tilting of the container box 4;

is a pneumatic actuator or a similar device, which controls the vertical shifting of the movable barrier wall 5;

is a chute along which the pirns 6 slide by gravity, from the box container 4 down to the metering belt 8;

is the arrow showing the direction along which the pirns 6 frontally fall downwardly when they leave the metering belt 8 along the chute 24 to be conveyed to the housing chamber 32, from which they are individually taken by a conveyor belt equipped with trays, not shown herein, but known from the prior art;

is the arrow showing the lifting direction of the movable barrier wall 2 under the action of the actuator stem 10;

is the arrow showing the lowering direction of the movable barrier wall 2 under the action of the actuator stem 10;

is the arrow showing the revolution of the tilting of the container box 4 bearing the accumulated amount of pirns 27;

is the high-slope chute conveying the pirns by gravity from the metering belt 8 to the housing chamber 32;

is the accumulated amount of pirns which stop along the chute 14 due to the effect of the barrier action performed by the movable barrier wall 2;

is the accumulated amount of pirns stored in bulk inside the container box 4;

is the arrow showing the direction of falling of the accumulated amount of pirns along the chute 14;

is an intermediate accumulated amount of pirns which forms along a length of the chute 14 due to the barrier effect of the movable barrier wall 3, positioned in its highest-lifted position;

is an optical sensor or an equivalent, which is capable of controlling moment by moment, the level of the pirns 6 laying on the metering and conveyor belt 8. Said sensor 30, of optical, electrical, or mechanical nature, or of a combination of two or more, is a level sensor known from the prior art. It will command the enabling, of a minimum, or maximum, amount of pirns 6 laying on the metering belt 8, and of the drive source of the actuator 10 which respectively actuates the sinking or lifting of the movable barrier wall 2;

is an optical sensor, or an equivalent sensor, capable of controlling moment by moment, the level of the pirns 6 upstream the movable barrier wall 2. It will command the enabling of the drive source of the actuator 11 which respectively actuates the sinking or lifting of the movable barrier wall 3;

is a housing chamber located at the lower end of the chute 24. Said chamber houses a limited number of pirns necessary for filling the tray compartments of a conveyor or lifter means known from the prior art.

is an optical sensor, or an equivalent sensor capable of controlling, moment by moment, the level of the pirns 6 upstream the movable barrier wall 3. It will command the enabling of the drive source of the actuator 13, which respectively actuates the sinking or lifting of the movable barrier wall 5;

is the variable-slope sliding chute of the pirns 6 during the tilting step; it also represents one of the side walls of the container box 4.

The operation of the device according to the present invention is now disclosed.

During the operation of an automatic coner machine, the many winding stations take the pirns from the travelling distributor.

Simultaneously, signals are sent which enable the drive source drives the metering belt 8, which to progress and consigns the pirns to the downstream device until the demand for pirns is met.

If, during said time of actuation of the metering belt 8, the level of the pirns laying on said belt 8 decreases below a predetermined and prearranged level, the optical sensor 30 detects such decrease and immediately enables the drive source of the actuator 10, which actuates the movable barrier wall 2 to sink, according to the direction shown by the arrow 20.

The accumulated amount of pirns 26, resting on the chute 14, no longer restrained by the movable barrier wall 2 which has been moved downward, slides down by gravity on the metering and conveyor belt 8. As soon as the level of the accumulated amount of pirns on the metering belt 8 exceeds the above-mentioned prearranged value, the optical sensor 30 gets obscured. A signal starts immediately which enables the drive source of the actuator 10 to actuate the movable barrier wall 2 making it go up according to the direction shown by the arrow 18. The falling down and sliding of the pirns 6 stops against the barrier formed by the movable barrier wall 2, and the accumulated amount of pirns 26 is reconstituted on the chute 14. On the metering and conveyor belt 8 a higher level is restored than the minimum prearranged level, and such restored level will be sufficient to continue to feed for a certain time interval, the downstream devices from which the requests for spinning pirns 6 have been sent. The metering and conveyor belt 8 will repeat its advancing cycles to meet the requests for pirn 6 supply. Said pirns feed the housing chamber 32 through the chute 24. In case the accumulated amount of pirns is small, such that after the lowering of the movable barrier wall 2 the minimum level of pirns on the metering and conveyor belt 8 is not reached, the optical sensor 30 by being not obscured within a programmable and pre-established time interval, sends a signal which enables the drive source performing the tilting of the container box 4. The container box is lifted and tilted through a pre-determined angle, with the accumulated amount of pirns 27 stored inside allowed to slide down by gravity along the chute 14. They then fall down and feed the metering belt 8 because the movable barrier wall 2 is down. As soon as the pirn 6 level reaches the preestablished and preset level, the optical sensor 30 gets obscured and sends a signal which enables the drive source of the actuator 10 and actuates the movable barrier wall 2 to make it lift according to the direction shown by the arrow 18. The lifting and the tilting rotation of the container box 4 proceeds until the plane 34 or the same or slightly higher box container assumes the same slope as the chute 14.

In as much as the movable barrier wall 2 performs a storage function by accumulating an amount of pirns 26 of a certain value, the box container 4, after reaching its highest tilting position is made to descend and is replaced by a new container filled with pirns, while the amount of pirns 26 accumulated on the chute 14 continues to lay on said chute.

In this way, the supply of pirns 6 to the metering and conveyor belt 8 during the operating step of container box 4 change is secured.

Figure 4:
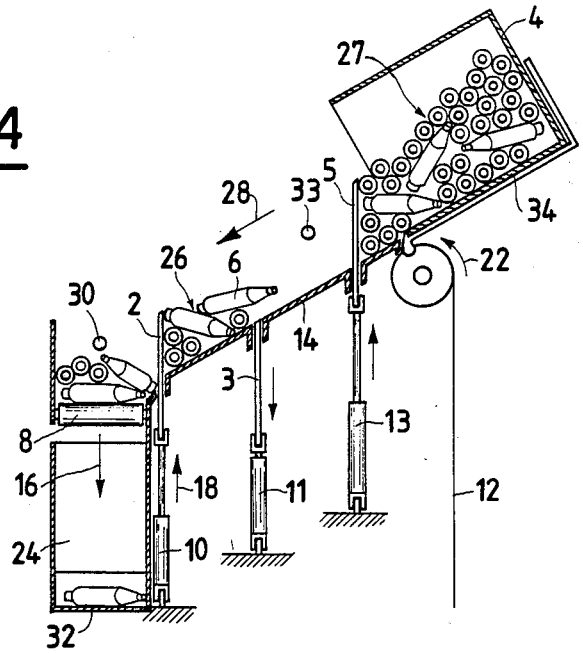
FIG. 4 is a side diagram of an operative variant of the solution displayed in FIG. 3.
Figure 3:
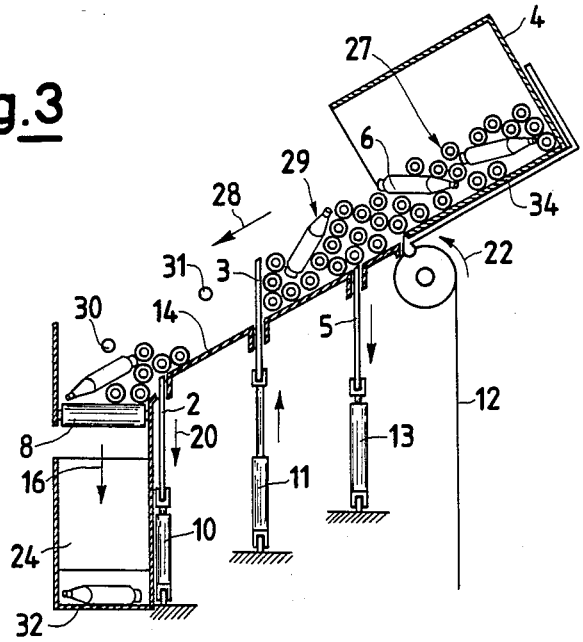
FIG. 3 is a side diagram showing the variant containing a plurality of movable barrier walls following each other to better carry out the dilution of the pirns.

A plurality of movable barrier walls can be provided as appears in the illustrative Examples shown in FIGS. 3 and 4.

According to such variants, when the level of the pirns 6 on the metering and conveyor belt 8 obscures the optical sensor 30, the movable barrier walls 2 and 5 are lifted, and the movable barrier wall 3 is lowered. Upstream of the movable barrier wall 2 there is the presence of an accumulated amount of pirns 26, while the amount of pirns 27 accumulated inside the container box 4 is retained by the movable barrier wall 5.

When the level of the pirns 6 on the metering belt 8 falls below the minimum level, the optical sensor 30 enables the drive source of the actuator 11 to actuate the movable barrier wall 3 to move upwards, while the drive sources of the actuators 10 and 13 are enabled to actuate the lowering of their respective movable barrier walls 2 and 5. After that, the accumulated amount of pirns 26 runs downward to feed the metering belt 8 and the accumulated amount 27 coming from the container box 4, spreads on the chute 14 until it stops and accumulates against the movable barrier wall 3, which performs a barrier function. Upstream of said movable barrier wall 3, an intermediate amount of pirns 29 is accumulated (see FIG. 3).

Now the drive source of the actuator 11 is enabled, to actuate the sinking of the movable barrier wall 3, and simultaneously to actuate the drive sources of the actuators 10 and 13. These actuate the lifting of their respective movable barrier walls 2 and 5 to restore the initial configuration as shown in FIG. 4. Then the intermediate accumulated amount of pirns run downwards by gravity along the cute 14, and stop and accumulate against the movable barrier wall 2. This reforms the accumulated amount of pirns 26 while the movable barrier wall 5 retains the amount of pirns 27 still accumulated inside the container box 4. It is also possible to prearrange optical level sensors inside the areas comprised between the movable barrier walls 3 and 5, and between the movable barrier walls 2 and 3, for the lowering and the lifting of one of the above said movable barrier walls. Upstream an optical sensor is driven in a similar way as above disclosed, by the optical sensor 30.

According to this improvement, the movable barrier wall 5 is driven to sink by the action of the drive source of the actuator 13, which is enabled when the optical sensor 33 detects a level of pirns 6 between the movable barrier wall 3 and the movable barrier wall 5, which is lower than the value of the minimum present value.

In a similar way, the movable barrier wall 3 is driven to sink by the action of the drive source of the actuator 11, which is enabled when the optical sensor 31 detects a level of pirns 6 between the movable barrier wall 2 and the movable barrier wall 3, which is lower than the value of the minimum present value.

In a similar way, the movable barrier wall 2 is driven to sink by the action of the drive source of the actuator 10, which is enabled when the optical sensor 30 detects a level of pirns 6 on the metering and conveyor belt 8, which is lower than the value of the minimum preset value.

The lifting of each movable barrier wall back to its lifted position is commanded when the respective optical level sensors are obscured again by the pirns 6.

It should be observed that, although the present invention has been disclosed by means of the application of either one or three movable barrier walls, the number of such dividing and diluting movable barrier walls can be made equal to 2, or 4, or more, without thereby going out of the scope of the invention.

A preferred solution, with some variants thereof, is herein disclosed, but other solutions are anyway possible.

We claim:

1. An apparatus for feeding pirns in a controlled manner from a source to a transfer means, comprising:

(a) a container for pirns adapted to be spaced from and above the transfer means and adapted to be tilted downwardly for discharging pirns therefrom, toward the transfer means;

(b) means for tilting said container downwardly for introducing and discharging pirns therefrom towards the transfer means;

(c) a downwardly sloped substantially linear chute extending from said downwardly tilted container to the transfer means for conveying pirns in a descending manner from said container to the transfer means therebetween;

(d) a substantially vertical moveable barrier wall adjacent to the transfer means, wherein said barrier wall is adapted to be lowered or raised to control the number of pirns at the transfer means;

(e) drive means connected to said barrier wall for controlling the height of said wall; and (f) sensing means operatively connected to said drive means for sensing the height of pirns at the transfer means, wherein said sensing means is adapted to activate said drive means to lower and raise said barrier wall and thereby control the number of pirns at the transfer means.

2. The apparatus of claim 1, wherein there are a plurality of barrier walls between said tilted pirn container and transfer means, wherein said barrier walls are adapted to be lowered or raised to control the number of pirns along the length of the chute and at the transfer means, wherein said drive means are connected to said barrier walls for selectively lowering and raising said barrier walls, and wherein said sensing means operatively connected to said drive means is adapted to sense the number of pirns along the length of the chute and at the transfer means, and activate said drive means to selectively lower and raise said barrier walls and thereby control the number of pirns along the length of the chute and at the transfer means.

3. The apparatus of claim 2, wherein there is a separate drive means for each of said barrier walls for controlling the height of the wall connected thereto.

4. The apparatus of claim 3, wherein there is a sensing means operatively connected to each of said drive means, and wherein each of said sensing means is adapted to activate the drive means it is connected thereto to lower and raise one of said barrier walls.

* * * * *